United States Patent [19]

Hoer

[11] Patent Number: 4,603,933

[45] Date of Patent: Aug. 5, 1986

[54] PLUG COUPLING HAVING PLUG PROTECTION

[75] Inventor: Leopold Hoer, Augsburg, Fed. Rep. of Germany

[73] Assignee: Siemens Aktiengesellschaft, Berlin & Munich, Fed. Rep. of Germany

[21] Appl. No.: 697,029

[22] Filed: Jan. 31, 1985

[30] Foreign Application Priority Data

Feb. 29, 1984 [DE] Fed. Rep. of Germany ..... 3407446

[51] Int. Cl.[4] ..... H01R 13/639

[52] U.S. Cl. ..... 339/75 P

[58] Field of Search ..... 339/75 P, 103 R

[56] References Cited

U.S. PATENT DOCUMENTS 3,223,958 12/1965 Prohl ..... 339/75 P
3,613,046 10/1971 Kirk ..... 339/75 P

FOREIGN PATENT DOCUMENTS 1084602 8/1980 Canada ..... 339/75 P
851652 7/1949 Fed. Rep. of Germany .... 339/75 P
2354647 1/1978 France ..... 339/75 P

*Primary Examiner*—John McQuade

[57] ABSTRACT

A plug coupling provides plug protection for the prevention of undesired separation of pin and socket parts in order to avoid transmission outages. In data technology, for example, it must be assured that connections produced outside of the apparatus cannot separate due to external influences. To this end, a plug coupling comprises a holder designed as a U-shaped part with a cross part at its lower end having inwardly bent tabs, the part embracing one of the connector parts and having a locking screw in the base of the U. A shackle is pivotally connected to the U-shaped part for embracing the other plug part. The shackle is also a U-shaped part and has a locking screw in the base of its U. A pair of hooks, one for each side, engage in respective bores of the U-shaped shackle and the U-shaped holder.

5 Claims, 11 Drawing Figures

FIG. 1A
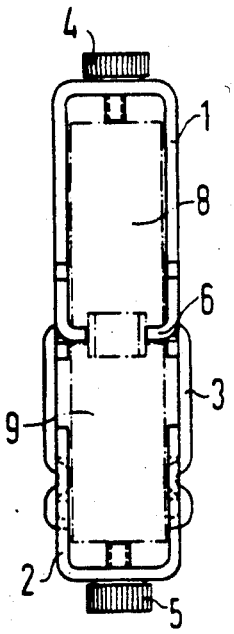
FIG. 1B
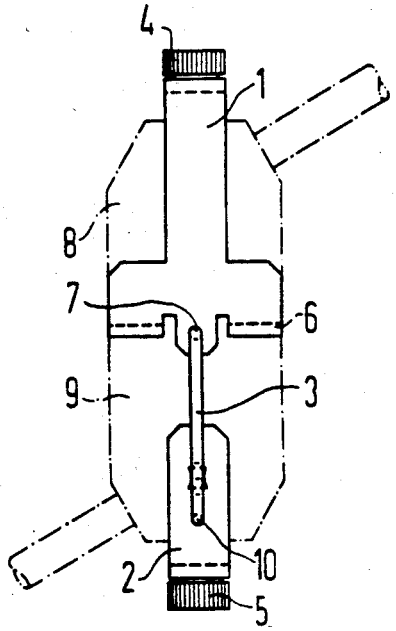
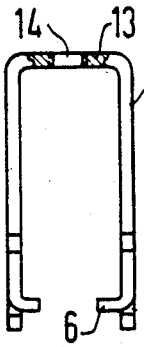
FIG. 2A
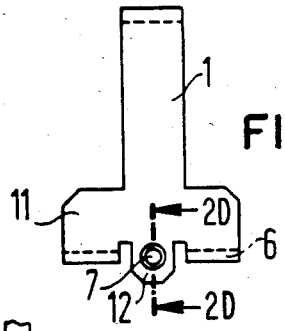
FIG. 2C
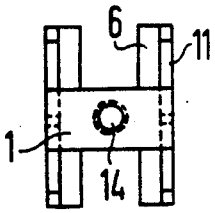
FIG. 2B
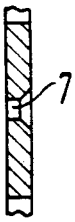
FIG. 2D FIG. 3A
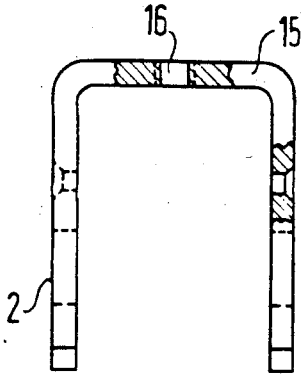
FIG. 3C
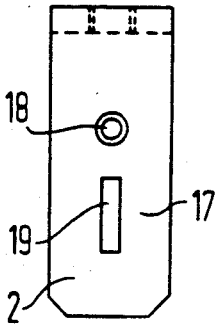
FIG. 3B
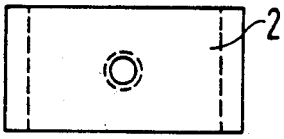
FIG. 4A
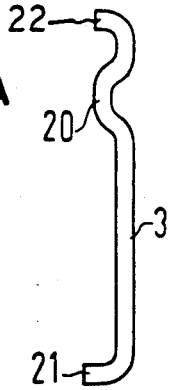
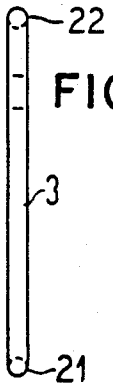
FIG. 4B

PLUG COUPLING HAVING PLUG PROTECTION

BACKGROUND OF THE INVENTION

FIELD OF THE INVENTION

The present invention relates to a plug coupling having plug protection in order to avoid undesired separation of the plug and socket of a plug-type connection.

For extending lines that are located outside of apparatus, for example, it is necessary to provide safeguards which prevent a separation of two plug parts.

SUMMARY OF THE INVENTION

The object of the present invention is to provide a plug coupling having plug protection so as to prevent the separation of, for example, a plug and socket.

In order to achieve the above object, according to the present invention, a plug coupling is realized by way of a holder fashioned cross-like in its lower part from a U-shaped shackle comprising inwardly bent tabs, the holder being provided with a first locking screw at a narrow side and which embraces one connector part, and a shackle which embraces the other connector part, which is likewise a U-shaped structure and at whose longitudinal sides a respective hook extending beyond the longitudinal sides and bent off at both its ends is secured, the hook engaging both in bores of the holder and in bores of the shackle and being additionally rigidly secured to the shackle and comprising a second locking screw at its narrow side.

As a result of the above measures, a plug coupling having a plug protection is obtained which can be quickly connected and just as quickly disconnected, and wherein, moreover, a good ground connection from one part to another is guaranteed and which, moreover, assures the spacing of the pins and sockets of the two plug parts as required by manufacturers. The coupling is also constructed of few piece parts and is simple to manipulate.

BRIEF DESCRIPTION OF THE DRAWINGS

Other objects, features and advantages of the invention, its organization, construction and operation will be best understood from the following detailed description, taken in conjunction with the accompanying drawings, on which:

FIG. 1*a* is a front view of a coupling constructed in accordance with the present invention;

FIG. 1*b* is a side view of the coupling of FIG. 1;

FIG. 2*a*, FIG. 2*b*, FIG. 2*c* and FIG. 2*d* illustrate the holder of the present invention in three different projections and in a fragmentary sectional view taken along the line 2D—2D of FIG. 2C;

FIG. 3*a*, FIG. 3*b* and FIG. 3*c* illustrate the shackle of the present invention in three different projections; and FIG. 4*a* and FIG. 4*b* illustrate the hook of the coupling shown respectively in front and side views.

DESCRIPTION OF THE PREFERRED EMBODIMENTS

Referring to FIGS. 1*a* and 1*b*, a plug coupling is illustrated which comprises a holder 1, a shackle 2 and a hook 3 secured to the shackle. The shackle 2 with the hook 3 and the holder 1 are pivotal relative to one another. The holder and the shackle contain locking screws 4, 5 which are constructed as knurled screws in the present example. The coupling occurs in that the holder 1, with the screw 4 backed out, is first slipped over one plug part 8 so that it completely encompasses the plug part and the lower edges 6 embrace the lower surface of the plug. Subsequently, the pivotal holder 2 is slipped over the other plug part 9 and the two plug parts 8, 9 are pressed against one another by tightening the screws 4, 5 and are therefore protected against separation. The lower edges or tabs 6 are designed such that they guarantee a good ground connection of the plug-tight connector to the coupling and assure the required spacing of the pins and sockets located in the plug parts.

The holder is illustrated in different views in FIGS. 2*a*, 2*b*, 2*c* and 2*d*. The holder comprises a metal part bent into a U-shaped configuration which comprises inwardly bent tabs 6 at the open side of the U. Additionally, the U-shaped part is designed cross-like at its lower-open end, whereby the tabs 6 are located at the lower edge of a cross beam 11, and a bore 7 is provided in the extended longitudinal part 12, the bore 7 being visible in the fragmentary sectional view of FIG. 2*d* taken along the parting line D—D of FIG. 2*c*. The bore 7 is countersunk on the outer side. It can be seen from the plan view of FIG. 2*b* that a further bore 14 is provided which serves for screwing in the locking screw 4.

As seen in FIGS. 3*a*, 3*b* and 3*c*, the shackle 2 is likewise designed as a U-shaped part and comprises a bore 16 at its narrow side 15 for receiving the locking screw 5. A further bore 18 and a slot 19 are provided in the longitudinal legs 17 of the shackle 2. One bent-back end of a hook 3 engages into the bore 18, whereas the hook 3, to be described with respect to FIGS. 4*a* and 4*b*, is located in the slot 19 so that the hook 3 is firmly connected to the shackle 2.

A specific design of the hook 3 is illustrated in FIGS. 4*a* and 4*b*. Both ends of the hook 3 are bent inwardly. The hook 3 is provided with a crimp 20 in the proximity of the upper bend 22. After the hook has been fastened to the U-shaped shackle, the crimp 20 is received in the slot 19, whereby the hook 3 and the shackle 2 are connected to one another. The hook 3 is thereby rigidly secured in the bore 18 and in the slot 19 and only the lower end 21 of the hook 3 is engaged into the bore 7 of the holder 1 such that the shackle 2 is pivotal with respect to the holder 1.

The plug coupler is particularly suitable for plug-type connectors in data processing apparatus.

Although I have described my invention by reference to a particular illustrative embodiment thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A plug coupler for preventing undesired disconnection of first and second connector parts, comprising:

a first U-shaped part for embracing the first connector part and including a base, a first locking screw extending through said base and a pair of legs extending from said base;

a pair of hook members each including a first end hook section pivotally connected to a respective leg and a second end hook section; and a second U-shaped part for embracing the second connector part and including a base, a second locking screw extending through said base and a pair of legs extending from said base and connected to said second end hook sections.

2. The plug coupler of claim 1, wherein the first connector part has a front surface and wherein:

said legs of said first U-shaped part each comprise at least one tab at the distal end engaging the front surface.

3. The plug coupler of claim 1, wherein the first connector part has a front surface and wherein:

each of said legs of said first U-shaped part comprises a crossbar at its distal end and at least one tab carried by said crossbar for engaging the front surface.

4. The plug coupler of claim 1, wherein:

each of said legs of said U-shaped part comprises means defining a slot therein; and each of said hook members comprises a detent section received in a respective slot.

5. The plug coupler of claim 1, wherein:

each of said legs of said U-shaped parts comprises a bore for receiving a respective hook section.

* * * * *